United States Patent [19]

Pardue, Sr. et al.

[11] Patent Number: 4,575,282

[45] Date of Patent: Mar. 11, 1986

[54] SYSTEM FOR DRIVING OPEN END PIPE PILES ON THE OCEAN FLOOR USING PNEUMATIC EVACUATION AND EXISTING HYDROSTATIC PRESSURE

[76] Inventors: James H. Pardue, Sr.; James H. Pardue, Jr.; Charles R. Pardue, all of Six Huntington Pl., Atlanta, Ga. 30338

[21] Appl. No.: 616,815

[22] Filed: Jun. 4, 1984

[51] Int. Cl.[4] ..... E02D 7/28; E02D 7/20

[52] U.S. Cl. ..... 405/228; 114/296; 405/224; 405/195; 405/232

[58] Field of Search ..... 405/224, 227, 195, 203, 405/204, 205, 232; 114/294, 295, 296

[56] References Cited

U.S. PATENT DOCUMENTS

| | | | |
|---|---|---|---|
| 99,359 | 2/1870 | Sickels . | |
| 2,021,014 | 11/1935 | Moran | 405/207 |
| 2,994,202 | 8/1961 | Knapp et al. | 405/224 |
| 3,263,641 | 8/1966 | Stimson | 405/224 X |
| 3,496,900 | 2/1970 | Mott et al. | 114/296 |
| 3,817,040 | 6/1974 | Stevens | 405/228 |
| 3,831,386 | 8/1974 | Phares et al. . | |
| 4,257,721 | 3/1981 | Hayes | 405/228 X |
| 4,318,641 | 3/1982 | Hogervorst | 114/296 X |
| 4,432,671 | 2/1984 | Westra et al. | 114/296 X |

FOREIGN PATENT DOCUMENTS

| | | | |
|---|---|---|---|
| 121774 | 7/1971 | Norway . | |
| 1025579 | 6/1983 | U.S.S.R. | 114/296 |

*Primary Examiner*—Dennis L. Taylor
*Attorney, Agent, or Firm*—Bacon & Thomas

[57] ABSTRACT

A new pile assembly is disclosed. It comprises an open end pipe pile (a cylindrical pipe pile provided with a pile cap) that is provided with: (1) a diaphragm adapted to slide axially within said open end pipe pile; (2) a conduit that allows gases and liquids to flow to and from the upper portion of the interior of said open end pipe pile through a conduit port; and (3) a one-way valve that allows gases and liquids to flow from an inlet port (that is below said conduit port) in the interior of said open end pipe pile to an exhaust port on the exterior of said open end pipe pile. The preferred embodiment of the invention also comprises: (4) an open end pipe pile with a lower end of reduced interior diameter; (5) means for retaining drilling mud in the lower portion of said open end pipe pile; and (6) a flexible riser in the interior of said open end pipe pile that provides a passageway for liquids and gases from said inlet port to said one-way valve.

A new process for driving an open end pipe pile into the sea floor at significant depths below the ocean surface is also disclosed. It comprises the steps of: (1) displacing liquid from the interior of an open end pipe pile (that has initially penetrated the sea floor) to the ambient by forcing compressed gas into the upper portion of said open end pipe pile; and (2) evacuating or venting said compressed gas from the upper portion of said open end pipe pile to the atmosphere thereby causing said pile to be driven by existing hydrostatic pressure. In the preferred embodiment of the process, the hydrostatic pile driving is done in a plurality of stages, with each stage comprising said steps (1) and (2). The preferred embodiment of the process also comprises the use of drilling mud: to provide lubrication between the diaphragm and the interior surface of the pipe pile, and between the exterior surface of the soil core and the interior surface of the pipe pile; and to give additional weight to the pile assembly thereby increasing the initial penetration of the sea floor, and preventing piping during the hydrostatic pile driving of step (2).

36 Claims, 22 Drawing Figures

48
52
5
47
49
7
44
46
45
43
4
6
3
8
39
33
34
56
38
35
36
37
5
5
8
9
41
40
40
41
1
2
26
23
2
21
24
26
26
13
17
21
17

52
55
5
4
10
56
36
33
39
34
35
38
37
11
1
1
55
11
31
30
32
6
6
12
1
55
2
28
27
26
25
13
17
21
17

SYSTEM FOR DRIVING OPEN END PIPE PILES ON THE OCEAN FLOOR USING PNEUMATIC EVACUATION AND EXISTING HYDROSTATIC PRESSURE

BACKGROUND

1. Field of the Invention

The present invention relates to a process of driving large, open end piles in the ocean floor. It also relates to apparatus for carrying out this process.

Geologists believe that the outer continental shelf and the continental slope will be the next major areas for oil and gas exploration. Organics have been raining down for millions of years, and the tectonic activity along the interface between the oceanic and continental crustal plates has provided continuous heat for distillation.

In the areas of the outer continental shelf and the continental slope, the water is considerably deeper than it is in the areas of the ocean where the oil and natural gas industry currently drills. In this deeper water, almost all offshore surface structures must float. With a few exceptions, they will not stand on fixed foundations. These floating structures will require reliable moorings to maintain their stations during severe weather. Failure to maintain station can result in loss of time and equipment and jeopardize both personnel and environment. An uncontrolled oil well left behind on the ocean floor would be an environmental disaster. Thus, in the near future, the offshore industry will need a new generation of reliable high capacity deep water moorings.

In deep water, an exploratory well can be drilled from a dynamically positioned ship. However, to complete and produce from such wells in these deep waters, a template must be installed on the ocean floor to secure the well head equipment and anchor the tension leg platform floating above. These templates require piles that have large capacities in tension in addition to their compression capacity. There is also a need in deep water for individual high capacity anchor piles where there is anything, permanent or temporary, floating above that must maintain its station.

Outer continental shelf and continental slope soils can vary, but most of these deep water deposits are soft and unconsolidated near the ocean floor. The simplest way to develop substantial holding power in these deep water soils is with the outside skin friction of piling which have significant penetration.

Using existing anchorage methods, it is anticipated that the cost of installing the anchorage system for a deep water offshore structure will be approximately 25 percent of the total in place cost of the structure. As the water depth increases, so does this percentage. As an alternative to these escalating costs, the new pile driving system presented herein provides a way to install a versitile, economical and dependable high capacity deep water anchorage system.

2. Description of the Prior Art

Large embedment anchors and dead weights are very expensive to install in deep water. They are also untrustworthy in soft soils, on slopes and in earthquake zones. Dead weights slide on the ocean floor; embedment anchors offer little resistance to non-horizontal loads; and long catenary anchor moorings are depth limited. Any anchorage system that does not significantly penetrate the ocean floor in areas of potential turbidity currents such as the continental slope, could instantly disappear.

Proposals have been made for underwater pile driving systems that include hydraulic hammers with power packs mated to the pile and jacking systems which attach themselves to a template. These remote control devices appear feasible. However, they would have to be gigantic to drive a large pile to a significant penetration depth in deep water. Hammers are depth limited and hydraulic jacking devices must jack against something.

The following is a description of certain U.S. patents, in numerical order, which disclose prior art technology.

U.S. Pat. No. 2,994,202 discloses a hydraulic jack. Hydraulic pressure is used to control the relative position of the earth penetrating member (column 1, lines 28–31). The lower end of the caisson is provided with a flushing line 58 (column 2, lines 40–43).

U.S. Pat. No. 3,263,641 discloses a suction plate. It comprises an open bottom compartment in selective communication with one or more closed fluid-tight compartments. A description of the use of the suction plate is provided beginning at column 2, line 71, and continuing through column 3, line 21.

U.S. Pat. No. 3,380,256 discloses an underwater drilling installation that is basically a drilling rig in a large tube. As shown in FIG. 7, seawater may be pumped from the interior of the tube after it has been lowered to the ocean floor.

U.S. Pat. No. 3,431,879 discloses an anchor box. Basically, the empty anchor box is transported to the location where it will function as an anchor, and then material from the ocean floor is pumped into the interior of the anchor to increase its weight.

U.S. Pat. No. 3,496,900 discloses a method for installing a deep water anchor. FIG. 3 includes a diagramantic illustration of the steps of one embodiment of the method. Tubular member 20 is provided with a concrete cap 24 and an open lower end 21 (column 3, lines 28–35 and 42–44). Cavity 25 in tubular member 20 is filled with seawater and lowered to the ocean floor (column 5, lines 1–10). Upon contact with the ocean floor, peripheral lip 15 penetrates the ocean floor thereby establishing a partial seal, and displacing a portion of the water in cavity 25 through pipe 36 (column 5, lines 11–26). The seawater and flowable mud in cavity 25 are removed by tube 36, line 40 and a pumping system. The hydrostatic force will push the anchor into the ocean floor (column 5, lines 27–35). It is noted that the anchor may be removed and salvaged (column 5, lines 60 through column 6, line 30).

U.S. Pat. No. 3,721,095 discloses a system for controlling the magnitude of a driving force being exerted on a substantially rigid object being driven into the earth, such as a pile. One aspect of this method involves providing a regulated feeding of pressurized fluid into a bounce chamber beneath a massive piston weight to cause the piston weight to bounce up and down (column 2, lines 34–38).

U.S. Pat. No. 3,805,534 discloses a slide resistant platform anchor conductor silo. Anchor 10 is provided with removable end closure 7, which is removed prior to the positioning of anchor 10 over the final location (column 2, lines 52–54). It is noted that reduction of the pressure inside anchor 10 below the hydrostatic head above the anchor 10 provides a penetrating force (column 2, lines 57–59).

U.S. Pat. No. 3,817,040 discloses a pile driving method. Tubular steel piling 1 is provided with piston 13. With reference to FIGS. 1*a*–1*d*, the piston 13 is initially positioned adjacent to the lower end of the piling 1. The piling 1 is placed on the ocean floor G. A high pressure jet of water is then directed through valve 9, jet-pipe 7 and nozzle 8 against the ground underlying the piling. As the water from this jet of water fills the lower portion of the piling 1, piston 13 is lifted upward (column 2, lines 31–40).

U.S. Pat. No. 3,820,346 discloses a free piston water hammer pile driving method. The free piston provides the pile driving action. The figures of the drawings illustrate pistons 10, 44, 80U, 80L and 174.

U.S. Pat. No. 3,832,858 discloses a process of placing piles in the ground. It includes an elevatable base so that the weight of the entire pile driving rig is applied to the pile.

U.S. Pat. No. 3,928,982 discloses a method and device for a foundation by depression in an aquatic site. One of the objects of the method is to avoid the disadvantage of piles having to be driven in (column 1, lines 35–36). The tank 6 is provided submerged pumps 13 that are adapted to pump water from beneath the tank 6, through filters 14 and columns 5.

U.S. Pat. No. 4,086,866 discloses anchoring devices. The second embodiment is illustrated in FIG. 5. In operation, member 10 is lowered to the ocean floor. Fluidizing water is supplied through pipe 54 and chamber 53 to apertures 55. An air-lift pump is provided in suction passageway 12 and comprises apertures 56 which are fed with compressed air from pipe 57. The fluidizing water from aperatures 55 in combination with the suction in passageway 12 act to remove material from beneath the body of member 10 thereby causing it to bury itself (column 7, line 45 through column 8, line 21).

U.S. Pat. No. 4,098,355 discloses a gas discharge underwater hammer with a valve to keep water out of the impact chamber. Generally speaking, a massive ram is guided up and down in a vertical tube. The ram falls on an anvil which is attached to the top of the pile or other element to be driven (column 4, lines 53–61).

U.S. Pat. No. 4,257,721 discloses a system for the placement of piles into the sea floor. With reference to FIG. 1, ram 15 is raised and lowered by a hydraulic system. As ram 15 is raised, a void is created on the bottom side of diaphragm 14. This creates a hydrostatic driving force which causes the pile to move downward into the sea floor as long as the magnitude of the pressure differential does not exceed the bearing strength of the sea floor sediment (column 3, lines 3–23).

U.S. Pat. No. 4,362,439 discloses a hydrostatically powered pile driver hammer. With reference to FIG. 9, a hydrostatic force is exerted downwardly on ram F causing it to move downwardly in tubular member 14 from the position shown in FIG. 8, through the position shown in FIG. 9, until the ram impacts the anvil E as illustrated in FIG. 10. The force of this impact is transferred from the anvil E to the housing engaged pile B to drive the latter downward (column 5, lines 19–25).

In addition to the foregoing, it is noted that suction anchor piles are the subject of printed publications. In this regard, reference is made to the article entitled "Suction Anchor Piles—A Proven Alternative To Driving Or Drilling" by Denis Senpere and Gerard A. Auvergne of Single Bouy Moorings, Inc., which appears in the 1982 proceedings of the Fourteenth Annual Offshore Technology Conference at Volume 1, 4231–4300, OTC 4206, pages 483–487.

The prior art includes a number of attempts to use hydrostatic pressure as a pile driving force on the ocean floor. These prior attempts have resulted in shallow penetrations of the ocean floor for three basic reasons.

First, there is the problem of plugging. A pipe pile will plug with soil during penetration when the inside skin friction becomes equal to the end bearing resistance of the cross sectional area of the pile. A simple pipe pile normally plugs when it has been driven to a depth equal to three or four times its diameter. On land this is not a problem. The pile driver overcomes the additional end bearing resistance and continues to drive the pile. When a pipe pile being driven hydrostatically on the ocean floor plugs, it will act like a tube closed at both ends and penetration stops.

Second, there is the problem of piping. To drive a pipe pile hydrostatically, you must lower its internal pressure. Piping is the rapid movement of soil and water from an area of high pressure on the ocean floor outside of the pipe pile to an area of lower pressure inside of the pipe pile. When piping occurs, soil and water enter the lower open end of the pipe pile faster than the pile is penetrating. When the pile is full of soil, penetration will stop. The path traveled by the material involved in piping is from the ocean floor down to the lower open end of the pipe pile and into the pile. When this path is short, the soils' resistance to piping is weakest and visa-versa.

Third, there is the problem of using a water pump in extremely deep water. When a pile is driven hydrostatically, the maximum pressure that can be applied is the existing hydrostatic pressure above the pile cap. When a water pump is used to pump water out of the pile at depth, thereby developing the pressure differential across the pile cap, the maximum unit pressure that can be applied to the pile cap is the rating of the pump. In deep water this will be less than the existing hydrostatic pressure. The pump must be attached to the pipe pile and it would be far out of reach should maintenance or adjustment be required.

SUMMARY OF THE INVENTION

The present invention is a simple pile driving system that uses simple apparatus. It overcomes the problems in the prior art pile driving systems and apparatus. The system of the present invention takes advantage of the hostile high pressure environment of the deep ocean. After initially penetrating the ocean bottom using the weight of the pile assembly, the fluid in the pipe pile is partially evacuated through a one way valve by pneumatic pressure delivered through a flexible conduit from the ocean surface. The pneumatic pressure is then released to the atmosphere through the same flexible conduit setting up a pressure differential across the pile cap. The pile is driven hydrostatically by the omnipresent high pressure near the deep ocean floor. The horizontal components of this pressure around the sides of the pipe pile counterbalance themselves. It is the vertical component of this existing hydrostatic pressure on the pile cap that drives the pile.

At a depth of about 1,370 m. (4,500 ft.), this driving force is about 140 kg/cm$^2$ (one ton per square inch) and it increases linearly with depth. As an example of the forces involved using this system, a pipe pile with a 1.8 m. (6 ft.) diameter at a depth of 2700 m. (9000 ft.) would be subjected to a driving force on the pile cap of over 72 meganewtons (8,000 tons).

If a cylindrical pile of circular cross section is used, the doubling of the diameter of the pipe pile causes a doubling of the vertical surface area and resistance to penetration, but causes a quadrupling of the area of the pile cap and the driving force. As explained hereafter, this method of pile driving does not develop any significant inside skin friction or end bearing resistance.

It is preferred that the present pile driving system not be used: where the sea floor is rock, gravel or coarse sand; with small diameter piles; and in shallow water. Generally speaking, the deeper the water and the larger the pile, the better the system works. It is preferred that the depth of the water be in excess of about 152 meters (500 ft.).

Among the advantages of the apparatus and process of the present invention are the following:

1. The pile assembly is easy to fabricate. The pile cap, diaphragm and friction reducer (diaphragm support 13) can be added to a "standard off-the-shelf" pipe pile at the most logistically convenient location.
2. The bigger the pile and the deeper the water, the better this pile driving system works.
3. An air compressor at the surface replaces a pile driver on the ocean bottom. Running the air compressor is analogous to raising a very large and efficient hammer.
4. There are no remote control devices at depth that could malfunction.
5. Piles driven with the system would have the capacity to anchor tension leg and taut leg platforms.
6. The pile can be retracted with an air compressor or a positive displacement water pump on a work barge.
7. A gauge at the surface to measure the pressure required to retract the pile can provide data which can be used to determine the in place tension capacity of the pile.
8. With the retraction feature and the ability to test its tension capacity, this pile driving system offers a reusable test pile.
9. The pile can be buried for a greater lateral load resistance.
10. A multi-pile template can be leveled on the ocean floor with this pile driving system.
11. This pile driving system can drive curved piles and long piles in one section without fear of column action.
12. End bearing resistance and inside skin friction which add nothing to tension capacity are minimal with this driving system. Because this pile assembly will not plug, resistance to penetration is substantially reduced.

Some of the capabilities listed above are either difficult, expensive or impossible for conventional pile driving equipment to perform on the deep ocean floor.

The present invention solves the prior art problems of plugging, piping, and using a water pump in extremely deep water. The problem of plugging is solved by the automatic placement of drilling mud during penetration, in an annular space between the interior surface of the pipe pile and the exterior surface of the soil core. The problem of piping is solved by placing drilling mud (or another, similar heavy fluid) in the pile assembly to increase its weight (and, therefore, its initial penetration of the ocean floor), and by using a pile assembly provided with a diaphragm having drilling mud above it. The problem of using a water pump in extremely deep water is solved by eliminating the need for such a pump.

The present invention is an improvement over the prior art because the pile assembly contains a minimal number of moving parts. The pile assemblies of the present invention are especially advantageous in the areas of the ocean where the depth of the ocean prevents divers from working on the ocean floor. Obviously, pile assemblies used at such depths must have a minimum failure rate. If a pile assembly malfunctions during pile driving at such a depth, it must be retracted or abandoned since there is no means to repair it. Generally speaking, a smaller number of moving parts produces a lower failure rate. The pile assemblies of the present invention need only two moving parts: a one-way valve; and a diaphragm. Preferably, they include both a third and a fourth moving parts, namely, a closure assembly and a mud circulating fan. The one-way valve allows gases and liquids from the interior of the pile assembly to be expelled to the ocean, but prevents sea water from entering the interior of the pile assembly when the interior pressure is reduced below the hydrostatic pressure at the ocean floor. The diaphragm seals the open end of the pile assembly until hydrostatic pile driving begins, and the weight of the drilling mud above the diaphragm prevents piping. The closure assembly prevents drilling mud from entering the flexible conduit connecting the interior of the pile assembly with the vessel at the ocean surface, thereby preventing the flexible conduit from becoming clogged. The mud circulating fan prevents entrained material from settling out of the drilling mud.

In the present application, the term "drilling mud" is used not only to refer to the drilling muds known to the art, but to any similar, heavy liquid. "Drilling mud" should: (1) have a density slightly greater than the ocean floor soils to be penetrated; (2) be capable of providing lubrication in both the annular space between the soil core and the pipe pile, and the annular space between the diaphragm and the pipe pile, and (3) be flowable through the one way valve. Since the "drilling mud" will be expelled into the open ocean at depth, it should obviously be as compatible as possible with that environment. Drilling muds conventionally used in the oil and natural gas drilling industry are typically a mixture of water, barite and bentonite.

In the present application, the term "fluid" means a liquid, but not a gas.

The process of the present invention is an improvement over the prior art in that it minimizes the number of necessary steps. After the pile assembly has been filled with sea water and drilling mud, it is lowered to the ocean floor. Hydrostatic pile driving requires only two steps: (1) forcing compressed gas into the interior of the pile assembly thereby expelling fluid; and (2) reducing the resulting gas pressure in the pile assembly thereby causing the hydrostatic force on the pile cap to drive the pile. Preferably, the pile driving process comprises a repetition of these steps to drive the pile incrementally.

In this application, both metric (e.g., meters) and non-metric (e.g., feet) units are used. Generally speaking, the non-metric units have been used in calculations, and then converted to metric units. Accordingly, if there is a discrepancy between the metric and non-metric units, then the value in the non-metric units is controlling.

DETAILED DESCRIPTION OF THE INVENTION

Figure 1:
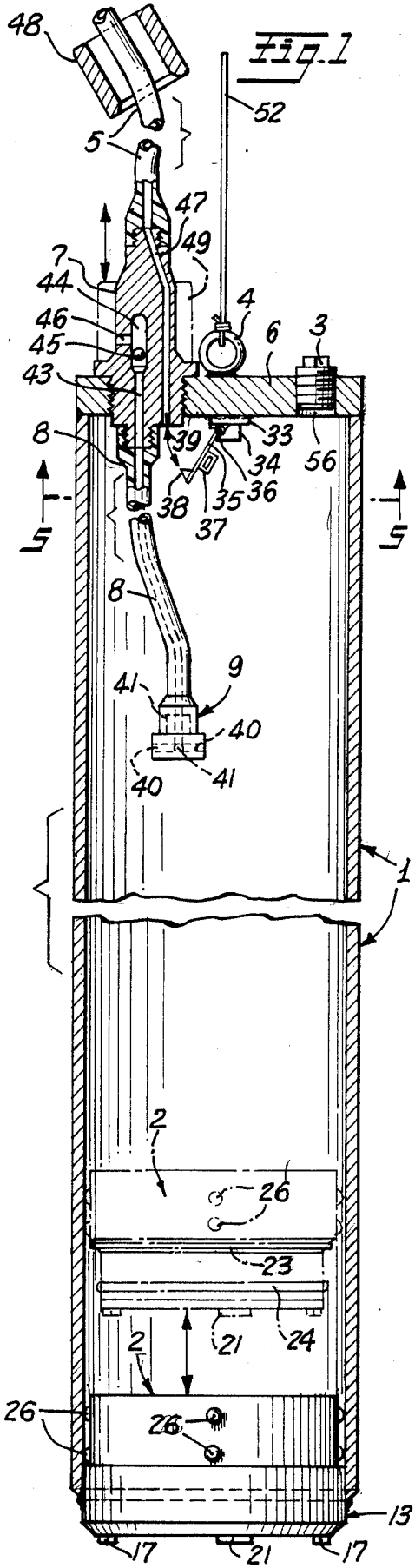
FIG. 1 is a fragmentary, vertical, sectional view, partly in elevation, of the pile assembly of the preferred embodiment of the present invention. An alternative position of the diaphragm 2 is shown in phantom lines.
Figure 2:
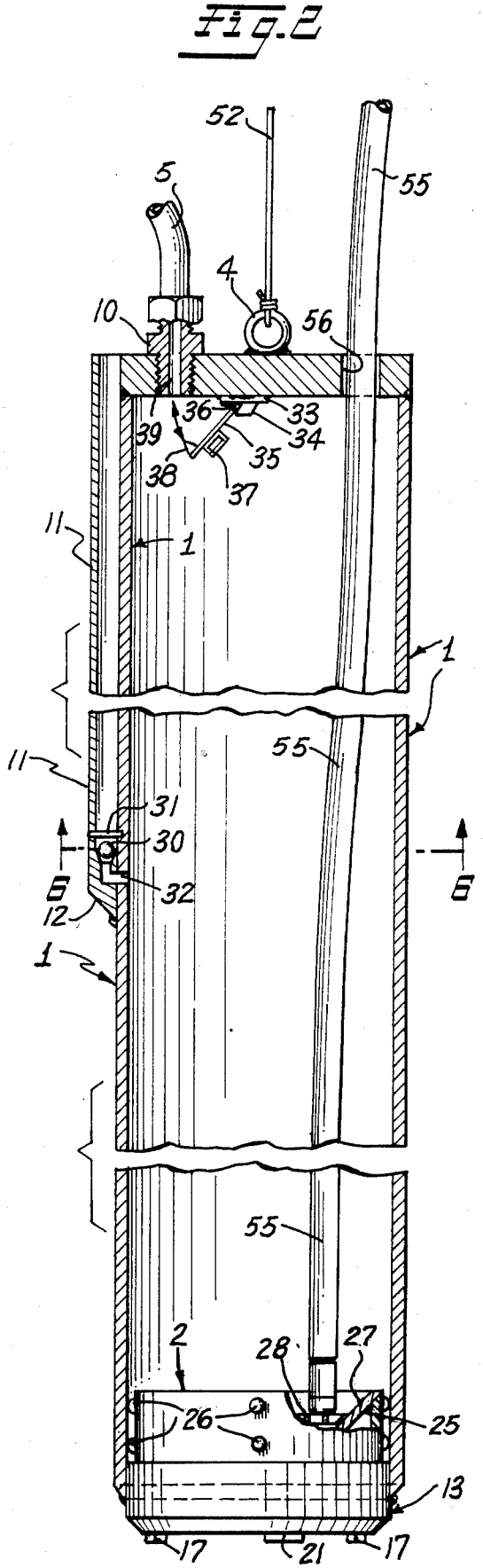
FIG. 2 is a fragmentary, vertical, sectional view, partly in elevation, of the pile assembly of the second embodiment of the present invention. The diaphragm is partially broken away to shown the end of the mud hose.

FIGS. 1 and 2 illustrate two pile assemblies of the present invention. As fully discussed below, FIG. 1 illustrates the preferred embodiment of the pile assembly of the present invention.

The pile assembly comprises pipe pile 1, which is a generally cylindrical member. In the preferred embodiment of the present invention, pipe pile 1 is of circular cross-section to better withstand external pressure. However, the shape of the cross-section of pipe pile 1 may be square, rectangular, oval, hexagonal or any other closed geometric figure, provided that the wall thickness is sufficient to prevent crushing.

Diaphragm 2 may be sealed against the lower end of pipe pile 1. Diaphragm 2 is adapted to slide axially in pipe pile 1 along the interior surface of pipe pile 1.

With reference to the preferred embodiment of the pile assembly of the present invention shown in FIG. 1, pile cap 6 is continuous with the upper end of pipe pile 1 thereby sealing the interior of the pipe pile assembly. Port cap 3 is reversably engaged with the mud hose port 56 in pile cap 6, thereby sealing the interior of the pipe pile assembly. The conduit closure assembly comprises baseplate 33 to which arm 35 is pivotally attached through hinge 36. Stop 34 is provided so that the degree of rotation of arm 35 about hinge 36 is less than 90 degrees from the horizontal, and preferably about 45 degrees from the horizontal. Arm 35 is provided with flotation chamber 37 which floats on drilling mud. Closure 38 is affixed to the end of arm 35 and adapted to be received by conduit port 39 when the level of drilling mud within the pile assembly causes flotation chamber 37 to float at a level whereby arm 35 is approximately horizontal. When arm 35 is approximately horizontal thereby engaging closure 38 in conduit port 39, liquid within the interior of the pile assembly is prevented from entering conduit port 39, conduit connector assembly 7 and flexible conduit 5.

Combined valve connector assembly 7 is reversibly engaged in pile cap 6, thereby sealing the interior of the pile assembly. Combined valve connector assembly 7 is provided with first conduit 43 whereby the interior of flexible riser 8 is allowed to communicate with a one-way valve comprising generally cylindrical chamber 44, sphere 45 and valve exhaust port 46. Combined valve connector assembly 7 is provided with a second conduit 47 whereby the interior of flexible conduit 5 is in communication with conduit port 39. Both flexible riser 8 and flexible conduit 5 are reversibly attached to combined valve connector assembly 7. The lower end of flexible riser 8 is connected to weighted head 9. The weight of weighted head 9 causes flexible riser 8 to be fully extended.

Head inlet ports 40 allow gases and liquids from the interior of the pile assembly to be passed to the exterior of the pile assembly through head conduits 41, the interior of flexible riser 8, first conduit 43, cylindrical chamber 44 and valve exhaust port 46. When the gas and/or liquid pressure in the interior of the pile assembly is greater than the fluid pressure on the exterior of the pile assembly, the one-way valve allows gas and/or liquid from the interior of the pile assembly to pass through head inlet ports 40, head conduits 41, the interior of flexible riser 8, first conduit 43, cylindrical chamber 44 and valve exhaust port 46 to the exterior of the pipe assembly. However, when the fluid pressure on the exterior of the pile assembly is in excess of the gas and/or liquid pressure on the interior of the pile assembly, sphere 45 seals against the oriface in the lower portion of cylindrical chamber 44, thereby preventing fluid from the exterior of the pile assembly from passing into the interior of the pile assembly. Thus, the one-way valve allows the pressure on the exterior of the pile assembly to reach a greater level than on the interior of the pile assembly, but prevents the pressure on the interior of the pile assembly from ever reaching a value significantly greater than the pressure on the exterior of the pile assembly unless exhaust port 46 is closed, which will be explained below.

FIG. 1 also shows messenger 48 which is a generally cylindrical member adapted to slide easily over flexible conduit 5 and fit over the exterior of combined valve connector assembly 7, as shown at phantom position 49, thereby sealing valve exhaust port 46. The term "messenger" is used for any of a number of devices that travel from vessels at the ocean surface to a submerged object. In the preferred embodiment, messenger 48 is a heavy cylinder. The interior diameter of messenger 48 is extremely close to the exterior diameter of combined valve connector assembly 7. When the messenger slides into the position shown at 49, it prevents gases and/or liquids from exiting through valve exhaust port 46. This allows the pressure in the interior of the pile assembly to reach a significantly greater level than the pressure on the exterior of the pile assembly when a pressurized gas or liquid is forced through the interior of flexible conduit 5, second conduit 47 and conduit port 39. This allows retraction of the pile assembly.

In a typical use of the pile assemblies of the present invention, the piles will be driven in the ocean floor, and a drilling platform anchored to these pile assemblies. When the drilling assembly and related apparatus no longer need to be anchored, it is desirable to retrieve the pile assemblies so that they can be reused. If this is the case, a messenger 48 can be sent to the combined valve connector assembly 7 of each pile assembly. Gas or liquid under pressure is then forced through the interior of flexible conduit 5, through second conduit 47 and conduit port 39. As this increases the pressure within the pile assembly above the diaphragm 2, the pile assembly will be forced upward out of the ocean floor. This occurs when the upward pressure within pipe pile 1 exceeds the exterior skin friction on pipe pile 1, the submerged weight of the pile assembly and the hydrostatic pressure on the top of pile cap 6.

As shown in FIG. 2, the second embodiment of the pile assembly of the present invention is provided with conduit connector assembly 10 which is attached to the flexible conduit 5. The second embodiment of the pile assembly of the present invention is provided with rigid riser 11 on the exterior of pipe pile 1. At the lower end of the exterior riser 11, one-way valve 12 allows selective communication between the interior of the pile assembly and the interior of rigid riser 11.

The interior surface of pipe pile 1 is provided with valve inlet port 32, which allows communication between the interior of the pile assembly and one-way valve 12. One-way valve 12 comprises a rigid member affixed to the exterior surface of pipe pile 1 having a channel which connects valve port 32 with the interior of rigid riser 11. One-way valve 12 is illustrated as comprising sphere 30 which is adapted to be received by inclined surfaces, and to be retained by retaining means 31. When the gas and/or liquid pressure in the interior of the pile assembly is greater than the fluid pressure on the exterior of the pile assembly, one-way valve 12 allows gas and/or liquid pressure from the interior of the pile assembly to pass through valve inlet port 32, valve 12 and rigid riser 11 to the exterior of the pile assembly. However, when the fluid pressure on the exterior of the pile assembly is in excess of the gas and/or liquid pressure on the interior of the pile assembly, valve 12 prevents fluid on the exterior of the pile assembly from flowing through rigid riser 11, valve 12 and valve inlet port 32 to the interior of the pile assembly. Thus, valve 12 is a one-way valve which allows the pressure on the exterior of the pile assembly to reach a greater level than on the interior of the pile assembly, but prevents the pressure on the interior of the pile assembly from ever reaching a value significantly greater than the pressure on the exterior of the pile assembly.

Pile cap 6 is sealed to, and continuous with, the upper surface of pipe pile 1. Mud hose 55 passes through mud hose port 56 so that the lower end of mud hose 55 rests on grate 28. Conduit connector assembly 10 is reversably engaged with pile cap 6. Conduit connector assembly 10 is attached to flexible conduit 5 thereby providing a continuous conduit from conduit port 39 through conduit connector assembly 10 and into the interior of conduit 5. The conduit closure assembly comprises conduit closure assembly baseplate 33 to which arm 35 is pivotally attached through hinge 36. Stop 34 is provided so that the degree of rotation of arm 35 about hinge 36 is less than 90 degrees from the horizontal, and preferably about 45 degrees from the horizontal. Arm 35 is provided with flotation chamber 37 which floats on drilling mud. Closure 38 is affixed to the end of arm 35 and adapted to be received by conduit port 39 when the level of drilling mud within the pile assembly causes flotation chamber 37 to float at a level whereby arm 35 is approximately horizontal. When arm 35 is approximately horizontal thereby engaging closure 38 in conduit port 39, liquid within the interior of the pile assembly is prevented from entering conduit port 39, conduit connector assembly 10 and flexible conduit 5.

Figure 3:
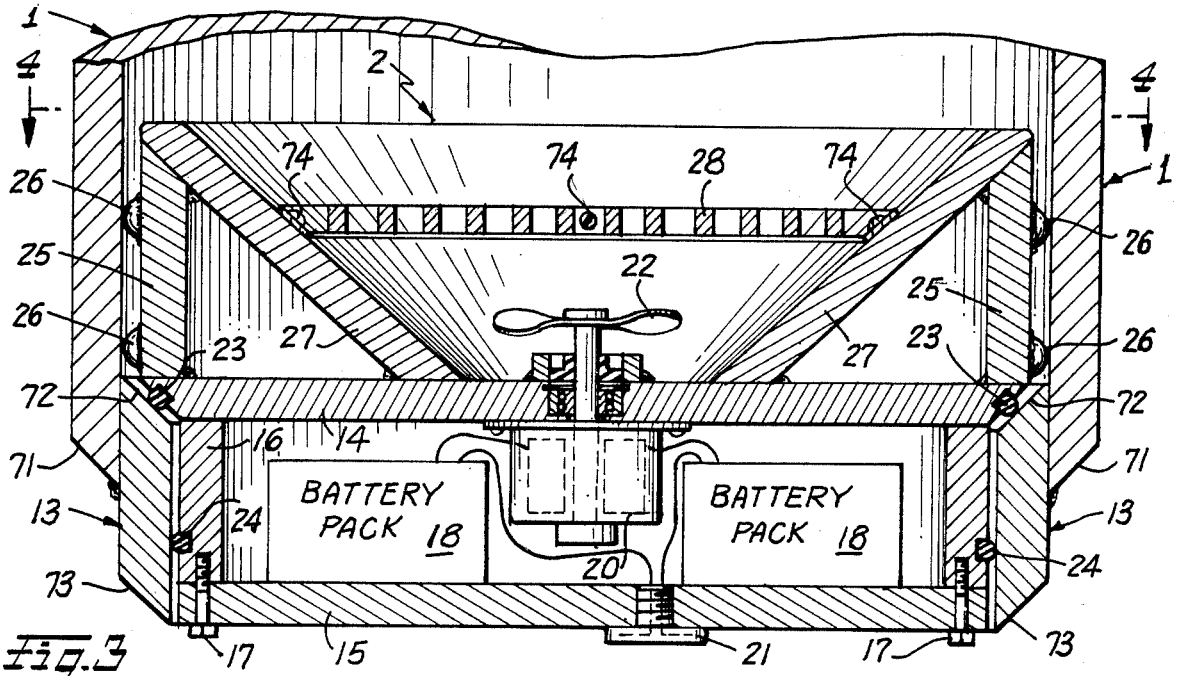
FIG. 3 is an enlarged, fragmentary, vertical, sectional view of the lower end of the pile assembly of both the preferred embodiment and the second embodiment of the present invention.
Figure 22:
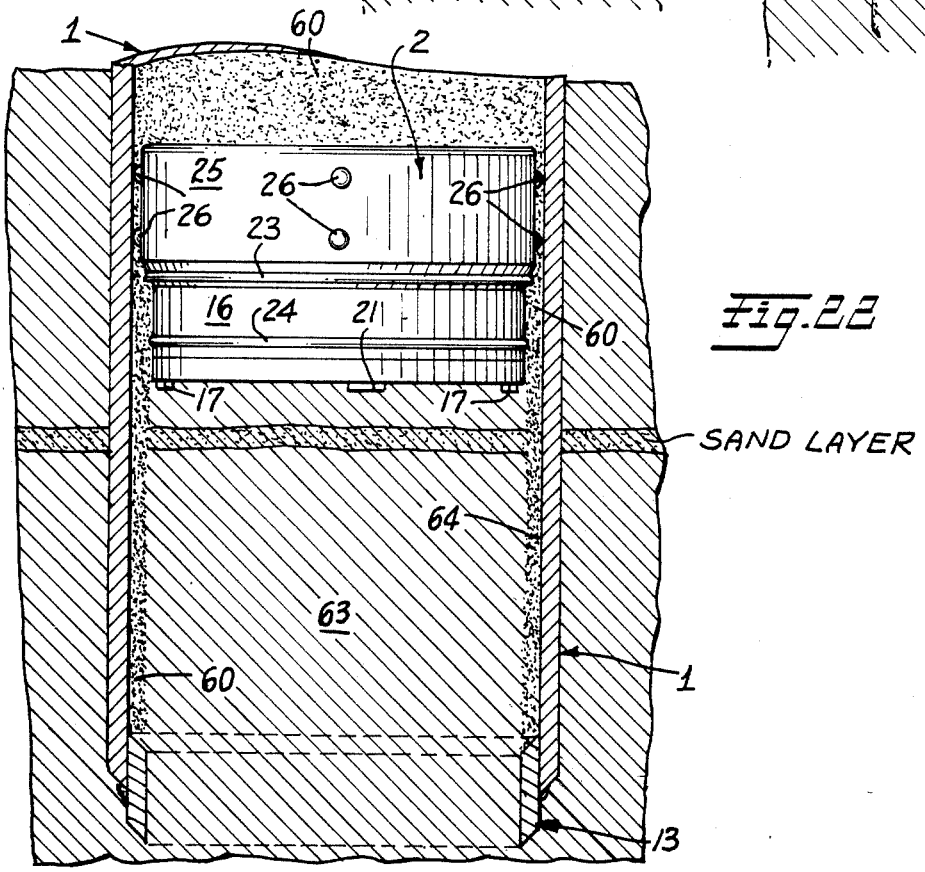
FIG. 22 is a fragmentary, vertical, sectional view, partly in elevation, of the lower end of both the preferred embodiment of the present invention, and the second embodiment of the present invention, after penetration of the ocean floor.

FIG. 3 illustrates the lower end of pipe pile 1, which has a reduced interior diameter that is slightly less than the interior diameter of the remainder of pipe pile 1. This reduced diameter is provided by diaphragm support 13. The reduction in diameter is sufficient to create annular space 64 between soil core 63 and the interior surface of pipe pile 1 that is more fully illustrated in FIG. 22. The drilling mud in this annular space 64 significantly reduces the friction of the soil core 63 on the interior wall of pipe pile 1 during penetration and retraction.

FIG. 3 also illustrates the diaphragm 2 of the present invention. The lower edge of pipe pile 1 is provided with a beveled edge 71. Diaphragm support 13 is attached (normally by welding) to the interior surface of the lower end of pipe pile 1, thereby forming a continuous member with pipe pile 1. Diaphragm support 13 is provided with upper and lower beveled edges 72 and 73, respectively.

Diaphragm 2 comprises top wall 14, bottom wall 15 and cylindrical side wall 16. The upper edge of cylindrical side wall 16 is attached to the lower surface of top wall 14, thereby forming a continuous member with top wall 14. Bottom wall 15 is removably attached to cylindrical side wall 16. Bolts 17 are shown as a means for removably attaching bottom wall 15 to side wall 16. Top wall 14, bottom wall 15 and cylindrical side wall 16 form a watertight compartment which houses a plurality of batteries 18, and electric motor 20, as well as electrical wiring connected to pressure switch 21 located in bottom wall 15. Pressure switch 21 is adapted to close an electric circuit when it detects a pre-selected pressure. When this pressure is detected, the circuit between a plurality of batteries 18 and electric motor 20 is completed. Assuming that the batteries are charged, electric motor 20 then drives mud-circulating fan 22. When operational, mud-circulating fan 22 causes the drilling mud in the lower portion of pipe pile 1 to circulate through the apertures in protective grate 28 and prevents the entrained material from settling out.

Mounted on the exterior of top wall 14 is upper cylindrical side wall 25. Attached to side wall 25 are a plurality of spacers 26 which keep diaphragm 2 centered within pipe pile 1. The spacers 26 can be fixed, or they can be ball bearings. Upper cylindrical side wall 25 is immediately adjacent to, and parallel with, the interior surface of pipe pile 1. The outside diameter of upper cylindrical wall 25 is smaller than the inside diameter of pipe pile 1. Side wall 25 forms a continuous member with top wall 14 and inclined wall 27. Inclined wall 27 is a conical section and is continuous with both top wall 14 and side wall 25. Grate 28 is removably attached by bolts 74 to inclined wall 27. O-rings 23 and 24 allow diaphragm 2 to be sealed against diaphragm support 13 in a manner sufficient to retain drilling mud in the interior of the pile assembly.

As shown in FIG. 3, top wall 14 and bottom wall 15 are parallel to each other, and perpendicular to cylindrical side wall 16. Cylindrical side wall 16, diaphragm support 13, upper cylindrical side wall 25 and the wall of pipe pile 1 are parallel to each other. Grate 28 is generally parallel to top wall 14, and protects mud-circulating fan 22 from large objects that may inadvertently enter the interior of the pipe pile assembly, and from weighted head 9.

Figure 4:
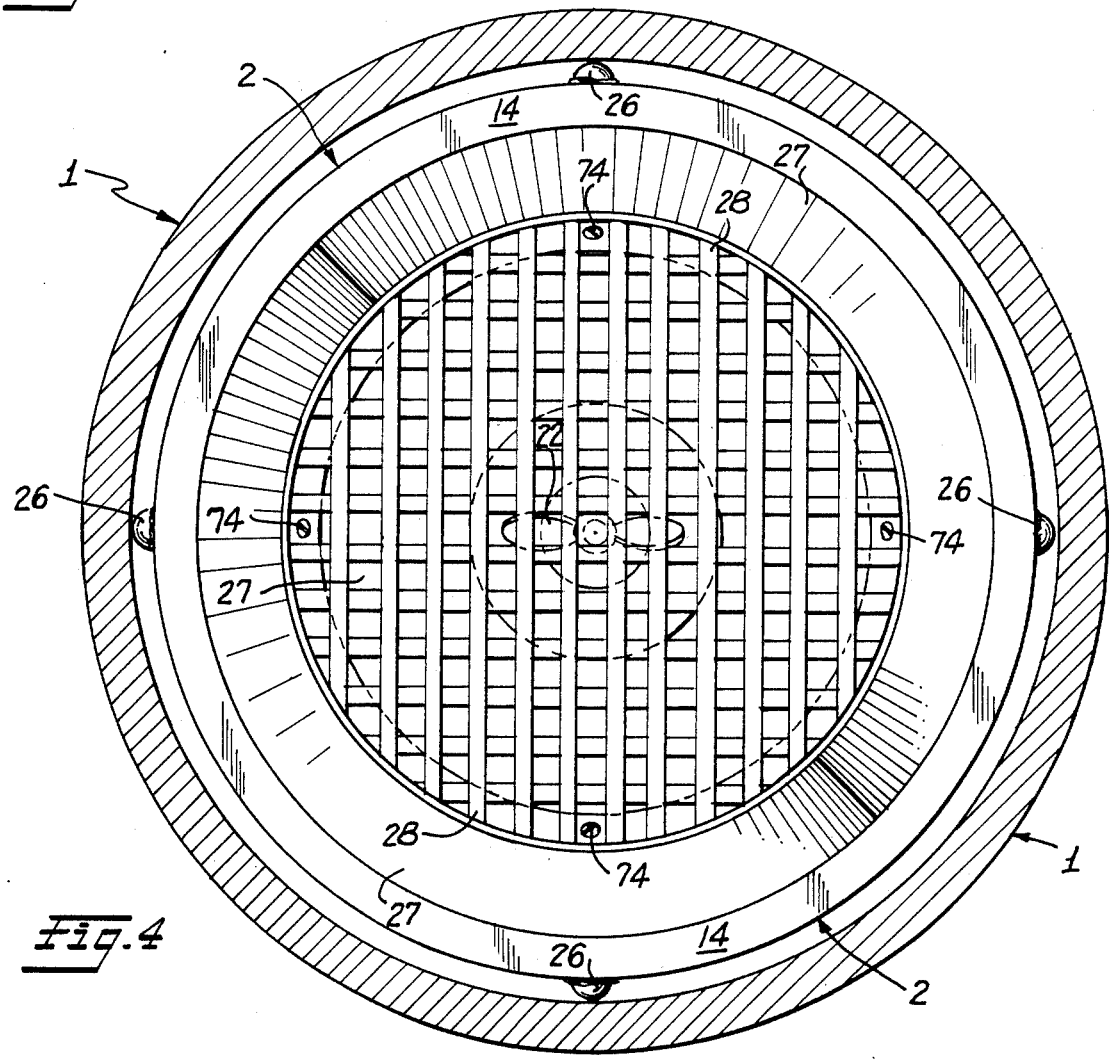
FIG. 4 is a horizontal, sectional view, taken along line 4—4 of FIG. 3.

FIG. 4 is a cross-section taken along line 4—4 of FIG. 3. Mud-circulating fan 22 is visible through the apertures of grate 28. Similarly, portions of the upper surface of inclined wall 27 are visible through the apertures in grate 28. A plurality of upper and lower spacers 26 attached to upper cylindrical side wall 25 are shown. A minimum of three equally spaced sets of spacers 26 is required to keep diaphragm 2 centered within circular pipe pile 1. However, more than three sets of spacers 26 may be used provided that they are generally equally spaced so as to keep diaphragm 2 centered within pipe pile 1. More sets of spacers may be necessary depending on the shape of the pile. For example, a pile with a square cross-section would require eight sets of spacers.

Figure 5:
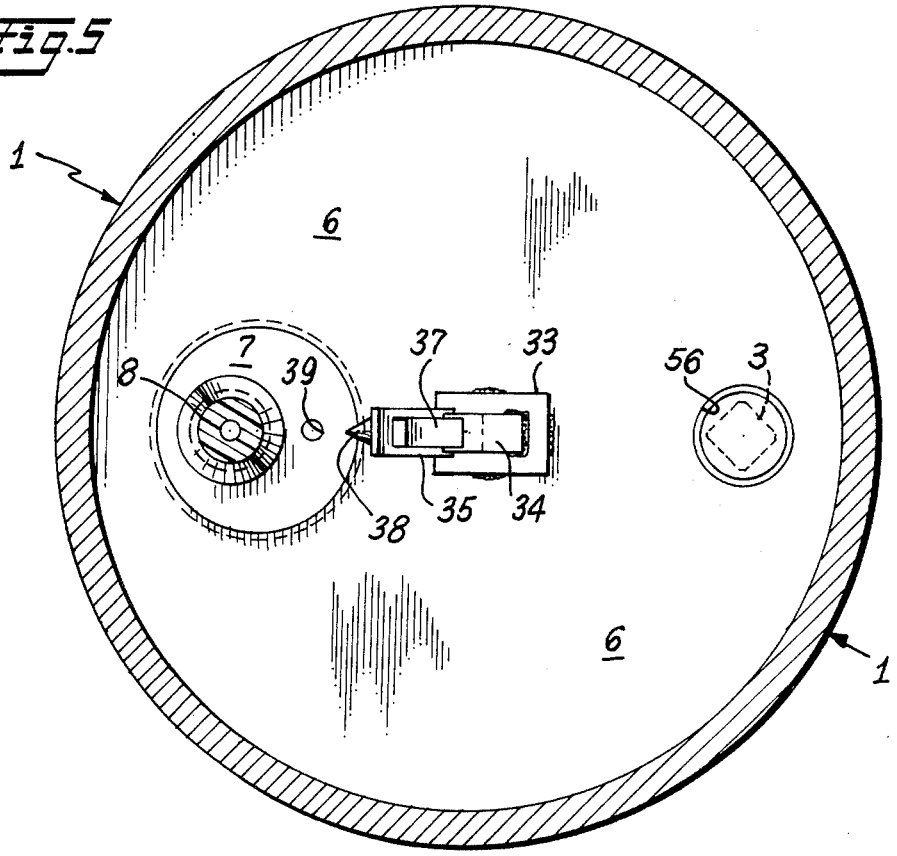
FIG. 5 is an enlarged, horizontal, sectional view, taken along line 5—5 of FIG. 1.

FIG. 5 is a cross-sectional view taken along line 5—5 of FIG. 1. FIG. 5 illustrates the lower surface of pile cap 6 of the preferred embodiment of the present invention. The lower surface of port cap 3 is visible in mud hose port 56. Closure plate 33 and the closure assembly are attached to pile cap 6. Flexible riser 8 and combined valve connector assembly 7 are also shown.

Figure 6:
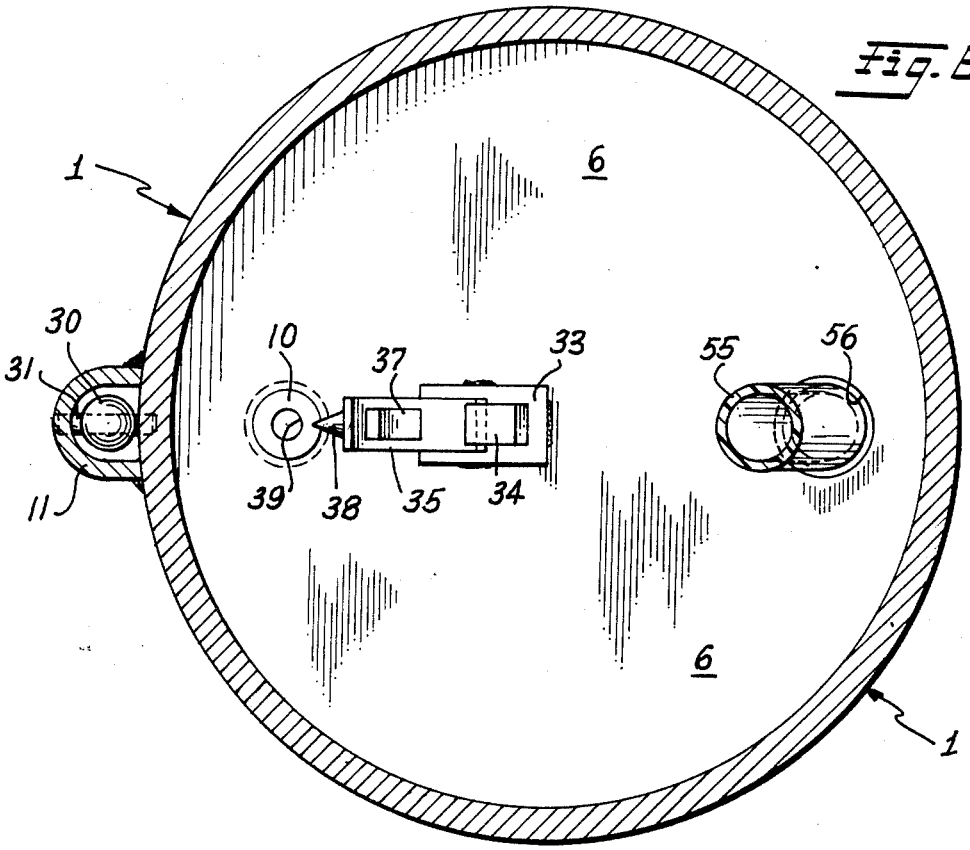
FIG. 6 is an enlarged, horizontal, sectional view, taken along line 6—6 of FIG. 2.

FIG. 6 is a cross-sectional view taken along line 6—6 of FIG. 2. It shows the circular cross-section of cylindrical pile 1. Rigid riser 11 comprises an approximately semi-circular cross-section that is continuous with the exterior surface of pipe pile 1. Since the cross-sectional view in FIG. 6 is looking toward the top of the pile assembly, the lower surface of pile cap 6 is shown. Also shown are mud hose 55, mud hose port 56, conduit connector assembly 10 and the conduit closure assembly that is more fully described above.

FIGS. 7 through 21 are schematic drawings illustrating a process of the present invention using the apparatus of FIG. 1, which will be described in the following fifteen steps.

Figure 7:
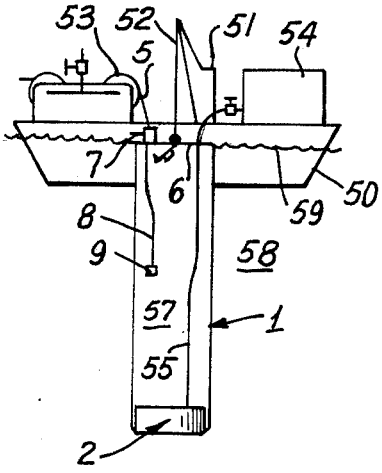
FIGS. 7 through 21 are schematic illustrations of the steps of a preferred process of the present invention.

In Step 1, as shown in FIG. 7, the pile assembly is attached to draw works 51 by anchor cable 52 which is attached to hook 4 on pile cap 6 as more fully illustrated in FIG. 1. The anchor cable 52 and the hook 4 are depicted schematically and represent any cable rigging attachment to the pile. The pile assembly hangs over the side of surface vessel 50, which in this case is illustrated as a work barge. The pile cap 6 is at the ocean surface 59. The pipe pile 1 is full of sea water 57. It is preferred that sea water 57 be filtered to remove objects and impurities which could disrupt the operation of mud circulating fan 22 (more fully illustrated in FIG. 3), the conduit closure assembly including closure 38, head inlet ports 40, and the one-way valve within the combined valve connector assembly 7 (as more fully illustrated in FIG. 1). With the pile assembly full of water, the diaphragm 2 seats itself on the diaphragm support 13 thereby sealing the exterior of the pile assembly from the interior of the pile assembly through the action of O-rings 23 and 24. The diaphragm support 13 is attached to the leading edge of the pipe pile 1 (as more fully illustrated in FIG. 3). Flexible conduit 5 is attached to combined valve connector assembly 7 and to a reel of flexible conduit 53 on the surface vessel 50. Port cap 3 is removed and mud hose port 56 in the pile cap 6 is open. Mud hose 55 is connected to a supply of drilling mud 54 on the surface vessel 50. The terminus of the mud hose 55 is lowered through mud hose port 56 to the bottom of the pile assembly so that it is immediately adjacent to the grate 28 which protects mud circulating fan 22 of the diaphragm 2 (more fully illustrated in FIG. 3).

Figure 8:
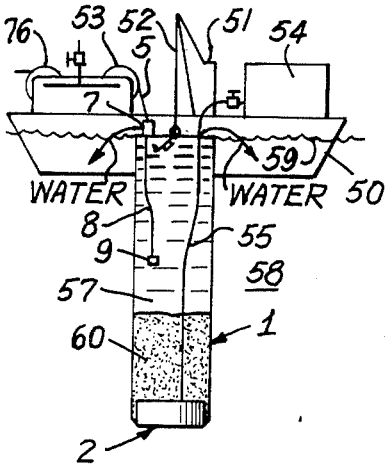

In Step 2 of the process according to the present invention, as shown in FIG. 8, drilling mud 60 from the supply of drilling mud 54 on the surface vessel 50 is introduced into the pile assembly tremie style through the mud hose 55. Since the end of the mud hose 55 is just above the top of the diaphragm 2, the drilling mud 60 displaces the sea water 57. The sea water 57 may be forced out of the pile assembly through the one-way valve in the combined valve connector assembly 7, or through the open mud hose port 56. The weight of the drilling mud 60 seats the O-ring seals 23 and 24 of the diaphragm 2 (as more fully illustrated in FIG. 3) to form a temporary seal at the bottom of the pile assembly.

Figure 9:
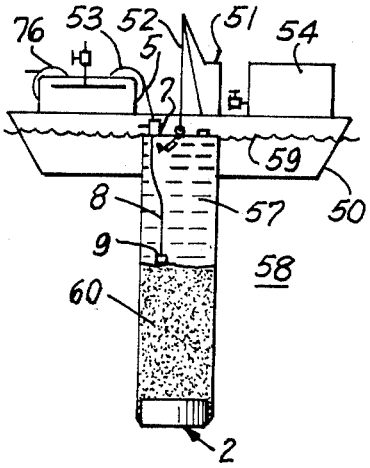

In Step 3, as shown in FIG. 9, the pile assembly is approximately half filled with drilling mud 60. The top surface of the drilling mud should be below the level of weighted head 9. Depending upon the particular conditions involved, it is possible that more or less of the interior of the pile assembly will be filled with drilling mud 60. These should be sufficient drilling mud in the pile assembly to (1) fill the entire annular space 64 (see FIG. 22) between the soil core and the interior surface of the fully driven pipe pile, (2) provide sufficient weight for an initial penetration of the sea floor (see Step 5), and (3) prevent piping action from forcing diaphragm 2 upward during hydrostatic penetration (see Step 8). The mud hose 55 has been withdrawn from the interior of the pile assembly, and mud hose port 55 closed by means of a port cap 3. At this time, water is pumped into the entire length of flexible conduit 5, including all of the flexible conduit 5 on the reel of flexible conduit 53, to stabilize pressures during the descent of the pile assembly to the ocean floor. During its descent, the weight of drilling mud 60 keeps diaphragm 2 sealed against the lower end of pipe pile 1. As the pile assembly descends to the ocean floor, relatively large hydrostatic pressures are encountered. However, these hydrostatic forces do not push diaphragm 2 upwards into the interior of pipe pile 1 because the hydrostatic pressure on the interior of the pile assembly is slightly greater than the hydrostatic pressure on the exterior of the pile assembly. This is due to the sea water which fills flexible conduit 5 from the combined valve connector assembly 7 to a level on the deck of surface vessel 50, which is above ocean surface 59. As the pile assembly descends to the ocean floor, the pressure switch 21 closes the electric circuit at a predetermined depth (hydrostatic pressure). The closing of the electric circuit causes batteries 18 to power electric motor 20 which drives mud circulating fan 22 (as more fully illustrated in FIG. 3). The chamber containing batteries 18 and electric motor 20 is preferably air tight, and is designed to give diaphragm 2 only a slight negative bouyancy with respect to the drilling mud 60.

Figure 10:
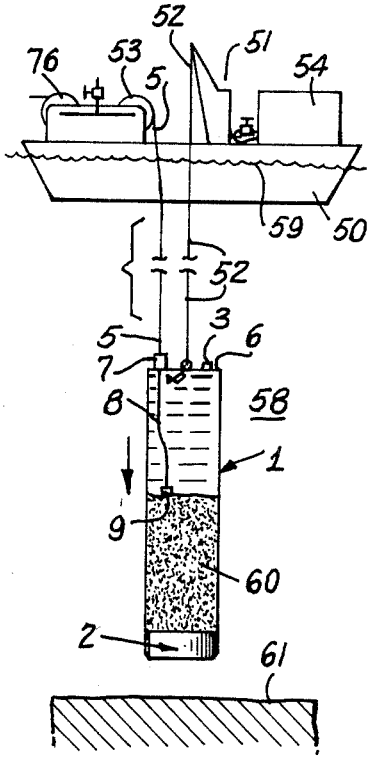

In Step 4, as shown in FIG. 10, the complete pile assembly is lowered to the ocean floor by draw works 51 on surface vessel 50, which plays out cable 52. As cable 52 is played out, a corresponding length of flexible conduit 5 is played out from the reel of flexible conduit 53 on the surface vessel 50.

Figure 11:
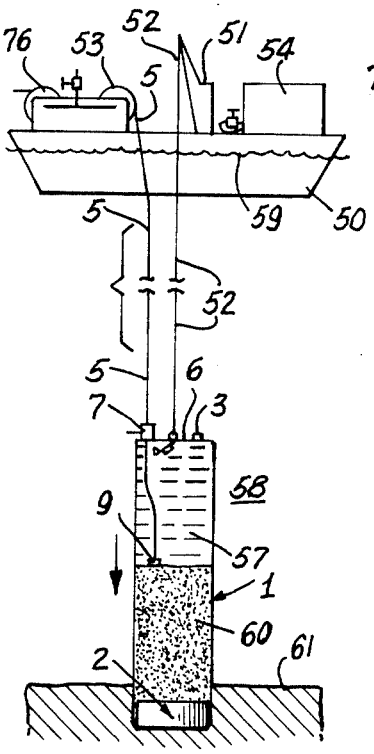

In Step 5, as shown in FIG. 11, the weight of the pile assembly causes the lower end of the pile assembly to make an initial penetration of the ocean floor 61. The depth of the initial penetration will depend on a number of factors, including the weight of the pile assembly, the strength of the soils in the ocean floor 61 being penetrated, and the amount of drag applied by the draw works 51 to the playout of the cable 52 to maintain pipe pile 1 in a vertical position. Due to the weight of the drilling mud 60 and the filtered sea water 57 above the diaphragm 2, the diaphragm 2 penetrates the ocean floor 61 coextensively with the lower terminus of pipe pile 1, which is formed by the lower edge of diaphragm support 13. Thus, the O-rings 23 and 24 continue to seal the diaphragm 2 against the diaphragm support 13 even after the initial penetration of the pile assembly into the ocean floor 61. However, even if the diaphragm 2 were displaced slightly upward into the interior of pipe pile 1 by the impact of the initial penetration of the ocean floor 61, this would not prevent the continued practice of the process of the present invention.

Figure 12:
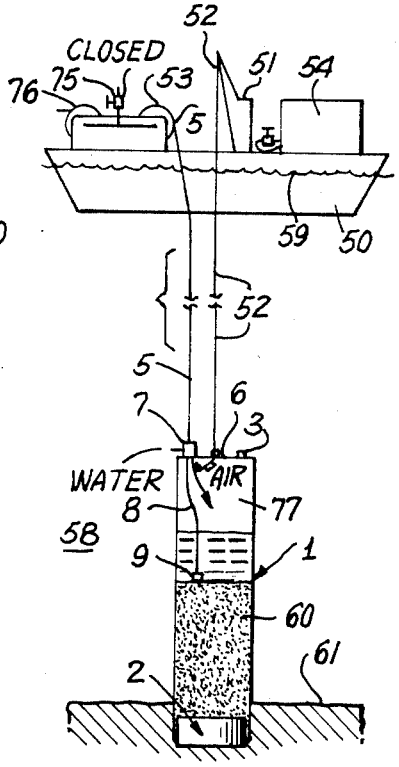

In Step 6, as shown in FIG. 12, vent valve 75 is closed and an air compressor 76 on surface vessel 50 is connected to the upper terminus of flexible conduit 5. Pressurized air is then forced down through flexible conduit 5, thereby forcing the sea water out of flexible conduit 5 and into the pile assembly. As pressurized air is forced down through flexible conduit 5 and into the interior of the pile assembly, liquid from the interior of the pile assembly is forced through head ports 40 of weighted head 9, through the interior of flexible riser 8, through first conduit 43 and generally cylindrical chamber 44 of combined valve connector assembly 7, and out into the open ocean 58 through valve exhaust port 46. While the pressurized air 77 is being forced into the interior of the pile assembly, the pressure within the pile assembly will slightly exceed the hydrostatic pressure on the top of the pile cap 6 because of the head of the column of water in the flexible riser 8. The pressure differential between the exterior and the interior of the pile assembly forces the diaphragm 2 against diaphragm support 13, thereby sealing the interior of the pile assembly from the exterior of the pile assembly through the O-rings 23 and 24. Thus, the net directional effect of this pressure differential is zero.

Figure 13:
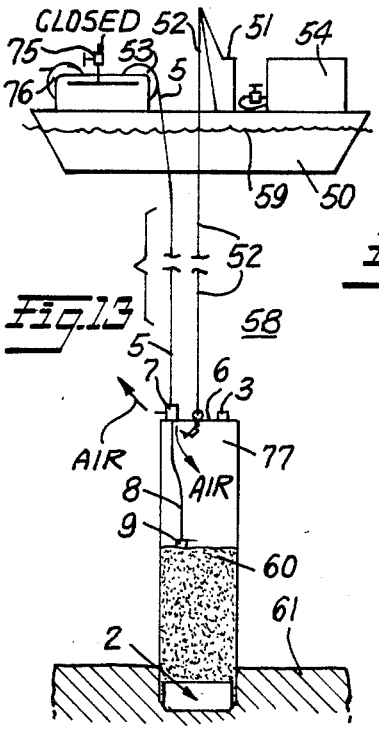

In Step 7, as shown in FIG. 13, the pressurized air 77 has forced the filtered sea water 57 out of the pile assembly from the pile cap 6 down to the level of the head ports 40 within weighted head 9. This will be noted at the surface by a slight drop in the pneumatic pressure gauge (which is not shown and reads the pressure within flexible conduit 5) which has heretofore been steadily rising. This pressure drop is the result of the pressurized air forcing the column of water out of flexible riser 8 thereby removing the hydrostatic head caused by this column of water. After this pressure drop, the gauge pressure at the surface of the ocean will stabilize. If pressurized air continues to be forced thorugh flexible conduit 5, air bubbles will exit from valve exhaust port 46 on combined valve connector assembly 7. At this point, the pressure within the pile assembly equals the hydrostatic pressure on the top of pile cap 6. The pressure on the top of diaphragm 2 is greater than the outside pressure on the bottom of diaphragm 2 because of the weight of the drilling mud 60 within the pile assembly.

Obviously, the amount of compressed air 77 in the pile assembly is controlled by the vertical position of the inlet ports 40 for the one-way valve. These inlet ports 40 are in weighted head 9. The vertical position of weighted head 9 is controlled by the length of flexible riser 8. The inlet ports 40 should never be at or below the bouyancy point of the pile assembly. If the interior of the pile assembly above the bouyancy point if filled with compressed air, then the pile assembly becomes bouyant. It is possible that a particular pile assembly would not have a bouyancy point because of its weight (i.e., it could be filled with compressed air and still not be bouyant). The inlet ports 40 should also be high enough so that an amount of drilling mud sufficient to prevent piping (see Step 8) remains above diaphragm 2.

Figure 14:
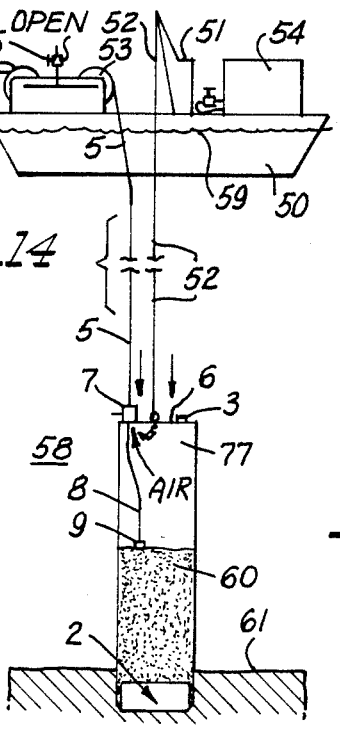

In Step 8, as shown in FIG. 14, the air compressor 76 is shut down. The terminus of flexible conduit 5 on the surface vessel 50 is provided with a vent valve 75. The vent valve 75 is opened thereby allowing pressurized air 77 from within the pile assembly to escape to the atmosphere through flexible conduit 5. As the pressurized air 77 from the interior of the pile assembly is evacuated to the atmosphere through flexible conduit 5 and the vent valve 75 on the surface vessel 50, the pressure within the pile assembly is reduced. As this interior pressure is reduced, the hydrostatic pressure outside the pile assembly causes a growing pressure differential to build up across the pile cap 6. As this pressure differential on the pile cap 6 begins to exceed both the drag of the draw works 51 (which maintains pipe pile 1 in a vertical position) and the resistance of the outside skin friction on the pipe pile 1 below the ocean floor 61, the pipe pile 1 begins to penetrate the ocean floor 61 further. As pipe pile 1 penetrates the ocean floor 61, diaphragm 2 remains in a relatively stationary position. Thus, diaphragm 2 begins to slide axially up through the interior of pipe pile 1. The pressure differential may not be reduced by sea water 58 entering the interior of the pile assembly. The one-way valve in combined valve connector assembly 7 prevents sea water 58 on the exterior of the pile assembly from flowing into the interior of the pile assembly to reduce the pressure differential across pile cap 6. The soils within the ocean floor 61 are prevented from entering the lower portion of the pile assembly because of the initial penetration of the pile assembly and because of the weight of the drilling mud 60 on top of diaphragm 2.

Figure 15:
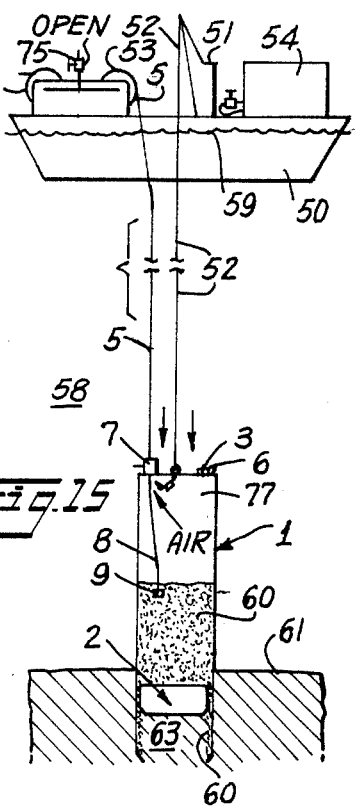

In Step 9, as shown in FIG. 15, the pipe pile 1 is pushed down into the ocean floor 61 by the hydrostatic head of pressure on pile cap 6. Diaphragm 2 remains in a relatively fixed position on top of the soil core 63 within the lower portion of the pile assembly. As pipe pile 1 moves down and the diaphragm 2 remains stationary, the drilling mud 60 which is slightly heavier than the soils being penetrated, flows down around diaphragm 2 and down into the annular space 64 (shown in FIG. 22) created between the soil core 63 and the inside surface of the pipe pile 1. This annular space 64 is created by the diaphragm support 13, which has an interior diameter that is smaller than the interior diameter of pipe pile 1. Thus, the exterior diameter of the soil core is smaller than the interior diameter of pipe pile 1. The drilling mud 60 which flows into this annular space 64 between the soil core 63 and the inside surface of pipe pile 1, minimizes the friction between the soil core and inside surface of the pipe pile 1, thereby preventing plugging and significantly reducing the resistance to penetration. The diaphragm 2 does not crush the soil core 63 within the lower portion of pipe pile 1, because it is designed to have only a slight negative bouyance when submerged in the drilling mud. The inside skin friction of pipe pile 1 has been minimized and, therefore, the pipe pile 1 will not plug. Accordingly, the end bearing resistance will be insignificant.

Figure 16:
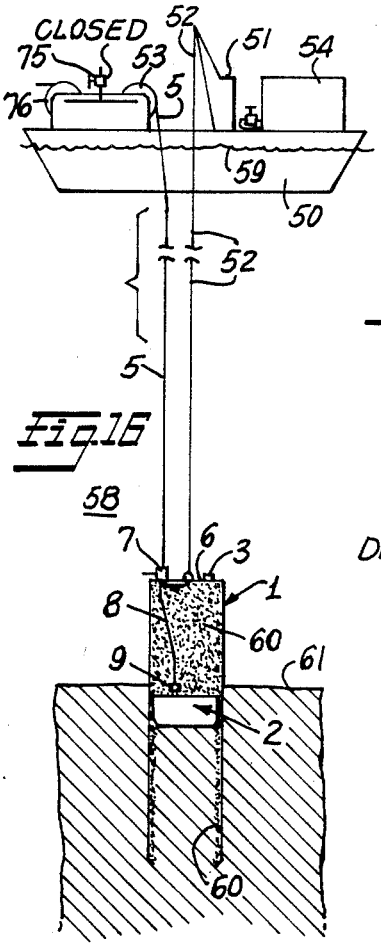

In Step 10, as shown in FIG. 16, pipe pile 1 has penetrated until the pile cap 6 has reached the top of the drilling mud 60 within the pile assembly. The rising level of the drilling mud in the pile assembly has caused closure 38 to engage conduit port 39, thereby preventing any further escape of fluids from the interior of the pile assembly. Since float 37 rides on the top surface of the drilling mud, a small amount of sea water (not illustrated) may remain immediately below pile cap 6. In addition, some sea water (not illustrated) may have been forced into and up flexible conduit 5. The pressure on both sides of pile cap 6 has equalized, and penetration has stopped. This halt in penetration will be indicated at the surface vessel 50 on the ocean surface 59 by the fact that draw works 51 cease to play out cable 52, and because the air escaping from the vent valve 75 attached to the terminus of flexible conduit 5 will cease. The pile assembly is now ready for the second stage of penetration.

The first stage of penetration has forced the pipe pile 1 a sufficient depth into the ocean floor 61 so as to prevent "piping". "Piping" is the rapid movement of soil and water from an area of high pressure outside of the pile on the ocean floor to an area of lower pressure within the pile. For piping to occur, soils outside the pipe pile must shear in a column from the ocean floor to the pile tip. This type of soil failure is resisted by the full shear strength of the soils involved. Penetration by the pile is resisted by the re-molded shear strength of the soils adjacent to the outside surface of the pipe pile. Re-molded shear strength is only a fraction of the full shear strength of a soil. Therefore, to relieve the existing pressure differential, it is easier for the pile assembly to penetrate than it would be for piping to occur. Should a relatively high potential for piping be anticipated when the piles are to be placed in very soft or semi-permeable soils, more drilling mud could be added to the interior of the pile assembly in Step 2. During the early stages of penetration when piping would be a concern and when only part of the existing hydrostatic pressure is required to drive the pile, a pressure regulating valve (not shown) could be attached to the vent valve at the surface to regulate the pneumatic pressure in the flexible conduit 5 and the interior of pipe pile 1 at a pressure higher than atmospheric pressure. Only that pressure differential across the pile cap required to drive the pile would be maintained by the pressure regulating valve (not shown) and the remaining higher than atmospheric pressure within pipe pile 1 would prevent piping during early stages of penetration.

FIGS. 7–21 illustrate a preferred process of the present invention. The pile is driven in two increments (Steps 8–9 and Steps 13–14). Obviously, the number of increments is controlled by the length of the flexible riser 8: if the flexible riser is about one-half the length of the pipe pile, then two increments; if the flexible riser is about one-third the length of the pipe pile, then three increments; and so on. The preferred number of increments varies based on a number of factors, including the length of the pipe pile, the shape (curved or straight) of the length of the pipe pile, and the nature of the soil on the ocean floor. Pile driving in five to seven increments would not be unusual. When the pile assembly is at the ocean surface, the length of the flexible riser can be readily changed: conduit 5 is detached from combined valve connector assembly 7; combined valve connector assembly 7 (including flexible riser 8 and weighted head 9, which are attached to assembly 7) is removed from pile cap 6 and placed onboard vessel 50; a new flexible riser of different length is attached to assembly 7 and weighted head 9; assembly 7 is engaged in pile cap 6; and conduit 5 is re-attached to assembly 7.

Figure 17:
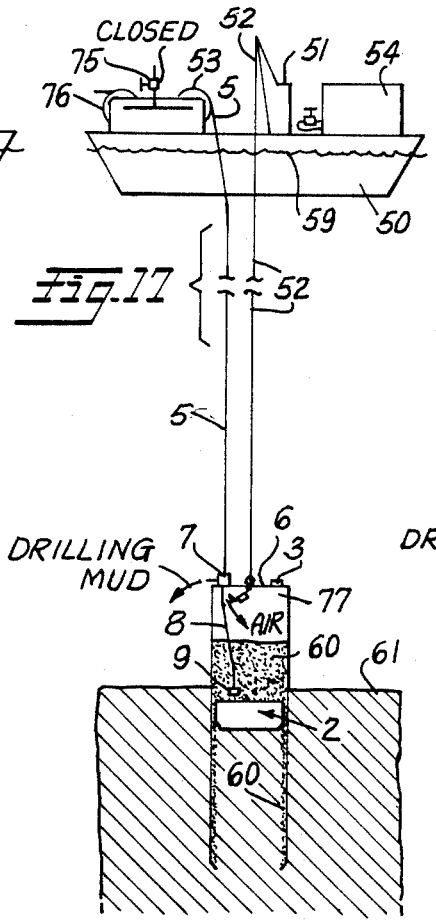

In Step 11, as shown in FIG. 17, the vent valve 75 attached to the terminus of flexible conduit 5 on surface vessel 50 is closed. The air compressor 76 is activated and pressurized air 77 is forced down through flexible conduit 5 into the interior of the pile assembly. Step 11 is quite similar to Step 6 in that liquid from the interior of the pile assembly is forced out into the open ocean 58 through flexible riser 8 and the one-way valve within combined valve connector assembly 7. Step 11 is dissimilar to Step 6 in that drilling mud 60 (rather than filtered sea water 57) is all, or a large portion, of the liquid displaced from the interior of the pile assembly. The same over pressure within the pile assembly that developed in Step 6 will also develop during Step 11. During Step 11, this over pressure is resisted by the submerged weight of the pile and the friction between the outside skin of pipe pile 1 and the soil beneath the ocean floor 61 developed during the first stage of penetration.

Figure 18:
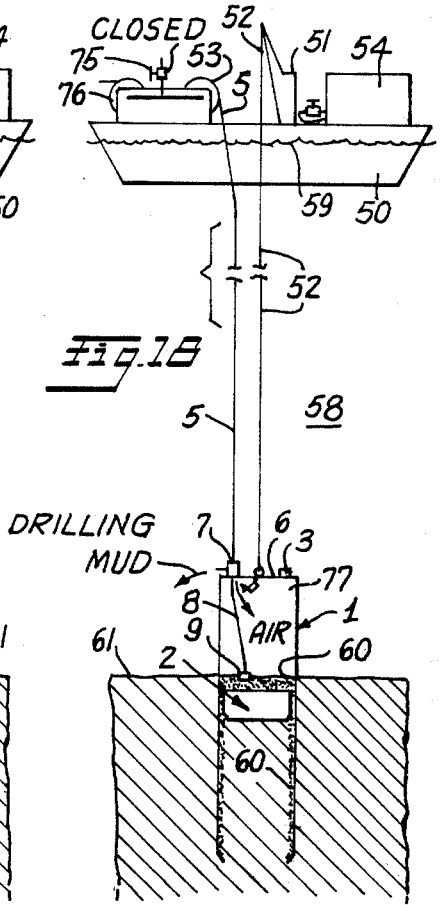

In Step 12, as shown in FIG. 18, a slight drop in the pneumatic pressure gauge (not shown) attached to flexible conduit 5 at the ocean surface will indicate that the liquid within the pile assembly has been expelled down to the level of the head ports 40 in weighted head 9, and from the interior of flexible riser 8. Compressed air will be forced through flexible riser 8 and the one-way valve within combined valve connector assembly 7 into the open ocean 58 as air bubbles if additional compressed air is forced into the interior of the pile assembly.

Figure 19:
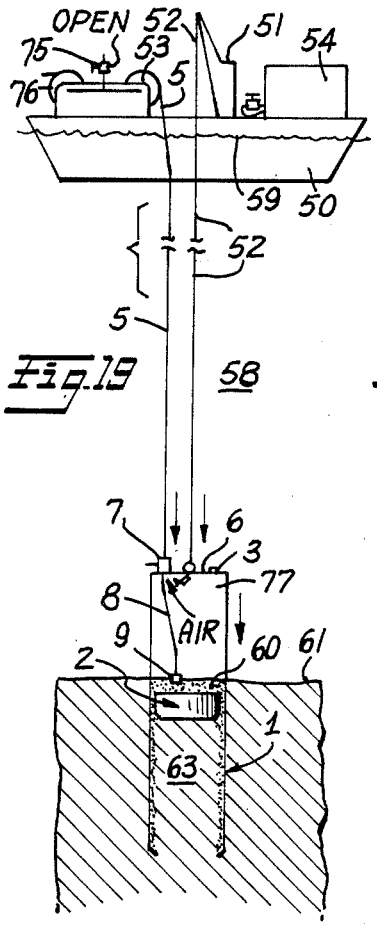

In Step 13, as shown in FIG. 19, the second stage of penetration is initiated by the shut down of the air compressor 76 and the opening of the vent valve 75 at the terminus of flexible conduit 5 on surface vessel 50. As the pressurized air 77 within the pile assembly is evacuated to the atmosphere through flexible conduit 5, the hydrostatic pressure on pile cap 6 increases and pushes the pipe pile 1 downward into the ocean floor 61. Water from the open ocean 58 is prevented from flowing into the interior of the pipe assembly by the action of the one-way valve within combined valve connector assembly 7.

Figure 20:
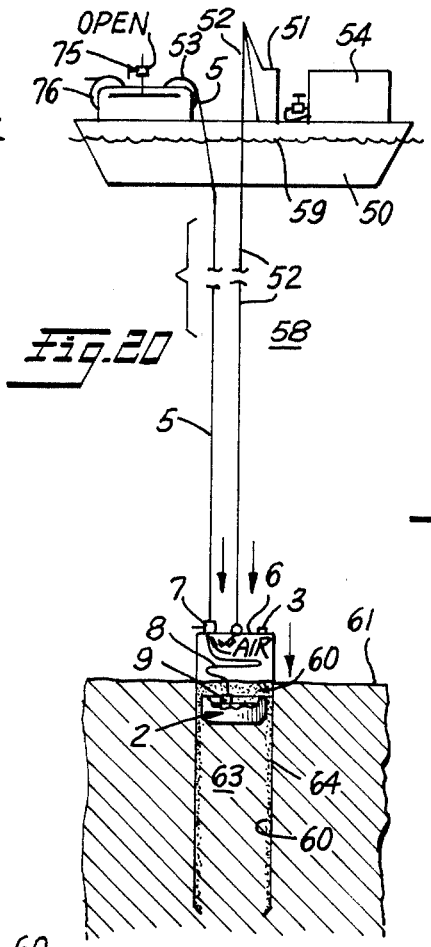

It is preferred that the length of flexible riser 8 be such that, at the end of Step 13, weighted head 9 is a minimum of a few feet above the top of diaphragm 2. This leaves a sufficient amount of drilling mud 60 to fill the annular space 64 during penetration in Step 14, as shown in FIG. 20. Alternatively, the structure of diaphragm 2 could be modified. For example, (with reference to FIG. 3), grate 28 could be placed on legs (not shown) attached to inclined wall 27. These legs would be of sufficient length to hold grate 28 at a position several feet above the upper end of inclined wall 27. In addition, the diameter of grate 28 would be enlarged to the diameter of cylindrical wall 25, and the outer edge of grate 28 would be provided with spacers, such as spacers 26 shown in FIGS. 3 and 4.

In Step 14, as shown in FIG. 20, the pipe pile 1 continues to penetrate the surface of the ocean floor 61 as it did in Step 9. Part of the remaining drilling mud 60 within the pile assembly fills the annular space 64 between the soil core 63 and the inside surface of the pipe pile 1, as more fully illustrated in FIG. 22. The drilling mud minimizes the inside skin friction, reduces the resistance to penetration, and precludes any possibility of plugging.

Figure 21:
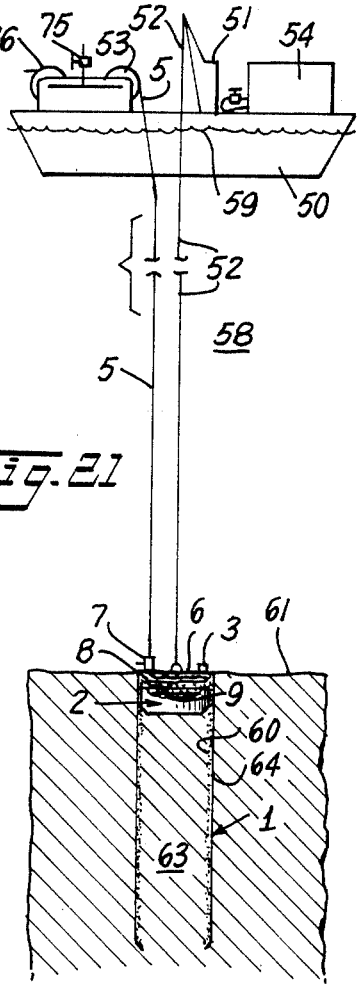

In Step 15, as shown in FIG. 21, all air has been expelled from the interior of the pipe pile assembly. The rising level of drilling mud within the pile assembly causes the conduit closure assembly to function thereby forcing closure 38 into engagement with conduit port 39. This prevents any drilling mud from entering second conduit 47 and flexible conduit 5. As shown in FIG. 21, the flexible riser 8 is no longer extended to its full length. It has been collapsed so it fits within the remaining space between diaphragm 2 and pile cap 6. As this point, the pipe pile 1 has been driven and may be used to anchor a surface vessel, drilling platform or any floating structure.

As discussed above, the length of each penetration increment is controlled by the length of flexible riser 8, when the preferred embodiment of the apparatus of the present invention is used. More precisely, the distance between the pile cap and the entry port 40 for the one-way valve controls the length of each penetration step. In the preferred embodiment, the entry port 40 is in weighted head 9 at the end of flexible riser 8. In the second embodiment, the entry port for the one-way valve is valve port 32, as shown in FIG. 2. Valve port 32 must always be above the midpoint of the pipe pile 1. Otherwise, valve port 32 would be below the upper surface of diaphragm 2 after Step 10, which would very probably cause one-way valve 12 to be nonfunctional in Step 11, thereby preventing any further pile driving. In actual practice, the placement of valve 12 and valve port 32 approximately one-fifth of the distance from pile cap 6 to the lower end of pipe pile 1 (thereby allowing penetration of the ocean floor in five increments) would not be unusual. Obviously, the length of rigid riser 11 would be adjusted accordingly.

The process of the present invention also encompasses a process of withdrawing the driven pile assembly from the ocean floor so that it may be reused. With reference to FIG. 1, messenger 48 is illustrated. If a group of piles have been used to anchor a particular drilling platform, and the drilling platform is to be removed, it is desirable to retract the driven piles. If the preferred embodiment of the apparatus according to the present invention (shown in FIG. 1) had been used, a messenger 48 is placed over the exterior of flexible conduit 5 at the ocean surface. The messenger is then allowed to travel along flexible conduit 5 until it becomes engaged around the combined valve connector assembly 7 on the pile cap 6 as shown by position 49. With the messenger in position 49, valve port 46 is blocked, thereby preventing the escape of gases and liquids from the interior of the pile assembly. At this point, the air compressor on a surface vessel is activated, and compressed air is forced through flexible conduit 5, second conduit 47 and conduit port 39 into the interior of the pile assembly. When the air pressure within the pile assembly exceeds the hydrostatic pressure on pile cap 6 and reaches a sufficient level to counteract the submerged weight of the pipe pile 1 and the frictional forces on the surfaces of the driven portion of the pipe pile 1, the pipe pile begins to retract from its driven position.

Obviously, instead of compressed air, the pile assembly could be retracted by forcing filtered sea water (or any other fluid) through flexible conduit 5 into the pile assembly with a positive displacement water pump (not shown).

With this retraction ability, the pile can test its own tension capacity. The tension capacity of the pile would equal the unit overpressure required to initiate retraction (indicated by a reduction of stress at the draw works and a sudden, rapid change in the reading of the pressure gauge on the water pump or the air compressor) multiplied by the internal cross-sectional area of the pile cap, plus the initial tension on the anchor cable 52. With this retraction ability, a test pile could be driven, tested, for tension capacity and retracted to furnish foundation design data for a proposed future deep sea drilling site. This test pile could also be adapted for use with in situ soil testing devices.

The foregoing explanation of the process according to the present invention was illustrated with two steps of hydrostatic penetration. Depending upon a number of factors, multiple steps of penetration could be used. In addition, when using the preferred embodiment, there is the possibility of a third step of penetration after Step 15 described above. Another step of penetration could be accomplished by again forcing compressed air 77 through flexible conduit 5 into the interior of the pile assembly above diaphragm 2. Since weighted head 9 now rests on the grate 28 protecting mud circulating fan 22, almost all of the drilling mud remaining within the pile assembly above diaphragm 2 could be forced out through the one-way valve in combined valve connector assembly 7. The maximum penetration of pipe pile 1 into the ocean floor 61 would be accomplished by opening the vent valve 75 on the ocean vessel 50 and allowing the compressed air 77 in the pile assembly to escape through flexible conduit 5 to the atmosphere. Since the initial penetration of the diaphragm 2 and the lower end of diaphragm support 13 into the ocean floor 61 upon termination of the descent of the pile assembly from the ocean surface causes the diaphragm 2 to be in a position below the level of the surrounding ocean floor 61, this final step of penetration can cause the top of pile cap 6 to be below the surface of the surrounding ocean floor 61. If it is determined that this last step of penetration to bury the pipe pile will require the lubrication of drilling mud, then grate 28 will have to be constructed a few feet above diaphragm 2 but still connected to it, as described in Step 13. The ability of this pile driving system to bury the pile would give the pile more resistance to lateral loads. This ability could also be used to level a multi-pile template on the ocean floor. By continuing to drive the piles on the high side, the template could be leveled.

In the embodiment of the process of the present invention described in Steps 1 through 15 above, the gas which fills the upper portion of the pile assembly in Steps 6 and 11 is forced into the pile assembly from the ocean surface through conduit 5. In another embodiment of the process of the present invention, this gas is generated by a chemical reaction inside the pile assembly. In one such embodiment, a gas generator (not shown) is attached to lower side of pile cap 6. The gas generator comprises a supply of a first liqiuid chemical reactant, a supply of a second liquid or solid chemical reactant, and reacting means for reacting said first and second chemical reactants to produce a gas. In Steps 6 and 11 of this process, vent valve 75 is closed. Then a signal is sent from the ocean surface that causes the gas generator to produce a first quantity of gas sufficient to force the liquid level in the pile assembly down to the level of the inlet port 40 in weighted head 9, and to force the liquid out of the flexible riser 8. The pressure of the generated gas is now equal to the hydrostatic pressure on the top of pile cap 6. These signals for a plurality of gas generations may be sent through electrical wires between the ocean surface and the pile cap, or by other suitable means. The vent valve 75 is opened reducing the pressure within the pipe pile 1 and the higher outside hydrostatic pressure causes pile penetration. Obviously, this embodiment of the invention eliminates the need for an air compressor 76.

Another feature of the present pile driving system is that it can be used to drive curved piles or long ones in a single section without fear of column action (i.e., the bending of a long slender column when it is compressed at both ends). Other than the submerged weight of the pile itself, the only unbalanced force acting on the pile above the ocean floor is the hydrostatic vertical force component acting downward on the pipe pile directly above the area of initial penetration. Because all other forces are balanced and there is no eccentricity in the application of the driving force, this pile driving system can drive a curved pile. No outside point force is applied to the pile. The pile is driven by the medium which surrounds it. This feature may be useful in driving surface casing from an offshore platform for a directional offset well.

In most applications, the pipe piles to be used in the present process are massive. This system is designed to drive long, large diameter piles of very high capacity. The pressures, loads and forces will also be very large. To generate the pneumatic pressures and volumes required will take something like a centrifugal compressor directly connected to a steam turbine rum by a ship's boiler. The flexible conduit 5 could be a plurality of small spirally reinforced seamless extruded tetrafluoroethylene (TFE) tubing with braided stainless steel covers. If a template is to be lowered with piles of the present invention hanging from it to anchor a tension or taut leg platform, drill stem (drilling pipe) attached to a manifold to each such pile on the template could replace flexible conduit 5.

In theory, if the pipe pile were heavy enough, one might think that the drilling mud 60 and the diaphragm 2 could be eliminated. However, it is preferred that the drilling mud not be eliminated because it performs many functions in addition to increasing the net weight of the pile assembly:

1. It provides weight to force the diaphragm to form a temporary seal at the bottom of the pipe pile until outside hydrostatic pressure initiates penetration.
2. It provides weight to overcome buoyancy.
3. It provides weight for initial penetration.
4. It provides weight to force the diaphragm below the mud line so that if desired, the pile can be buried.
5. It provides weight in the lower portion of the pile assembly for stability.
6. It provides weight to help prevent piping during the early stages of penetration.
7. It provides a fluid in the annular space between the soil core and the inside surface of the pile to minimize inside skin friction during penetration and retraction.

It is to be understood that the embodiments of the invention herein shown and described are to be taken as preferrd examples of the same, and that various changes in the shapes, sizes, arrangement of parts, compositions and methods of use and operation may be resorted to, without departing from the spirit of the invention or scope of the subjoined claims.

We claim:

1. A pile assembly comprising:

a cylindrical pipe pile;

a pile cap attached to the upper end of said pipe pile and forming a continuous member with said pipe pile;

a diaphragm adapted to slide axially in said pipe pile;

conduit means for allowing the flow of gases and liquids to and from the upper part of said pile assembly through a conduit port in the interior of said pile assembly;

one-way valve means for allowing the flow of liquids and gases from an inlet port in the interior of said pile assembly below said conduit port to an exhaust port on the exterior of said pile assembly, and preventing the flow of liquids and gases from said exhaust port to said inlet port;

retention means for retaining said diaphragm in said pipe pile; and attachment means for attaching the upper end of said pile assembly to an anchor cable.

2. The pile assembly of claim 1, further comprising: a rigid riser on the exterior of said pipe pile forming a continuous member with said pipe pile, said rigid riser forming a passageway for liquids and gases between said exhaust port and said one-way valve means;

and wherein said inlet port is in the sidewall of said pipe pile at a position above the midpoint of said pipe pile, and said one-way valve means is attached to said inlet port.

3. The pile assembly of claim 2, wherein said pipe pile is provided with a lower end of reduced internal diameter, and said pile assembly further comprising sealing means for retaining a quantity of drilling mud within the lower portion of said pipe pile above said diaphragm.

4. The pile assembly of claim 3, further comprising means responsive to a signal from the sea surface for closing said exhaust port.

5. The pile assembly of claim 3, wherein said diaphragm is provided with a mud circulating fan, and said pile assembly further comprises a closure means for preventing drilling mud from entering said conduit means.

6. The pile assembly of claim 1, further comprising a flexible riser forming a passageway for liquids and gases from said inlet port to said one-way valve means.

7. The pile assembly of claim 6, wherein said pipe pile is provided with a lower end of reduced diameter, and said pile assembly further comprises sealing means for retaining a quantity of drilling mud within the lower portion of said pipe pile above said diaphragm.

8. The pile assembly of claim 7, wherein said exhaust port is adapted to be closed by a messenger from the ocean surface.

9. The pile assembly of claim 7, wherein said diaphragm is provided with a mud circulating fan, and said pile assembly further comprises a closure means for preventing drilling mud from entering said conduit means.

10. A process of driving an open end pipe pile on the sea floor comprising the steps of:

(1) filling said open end pipe pile with a liquid;

(2) causing the lower end of said pipe pile to make an initial penetration of said sea floor;

(3) filling the upper portion of said pipe pile with a gas thereby displacing liquid from the interior of said pipe pile through a one-way valve means; and (4) evacuating said gas of step (3) from the upper portion of said pipe pile thereby causing said pipe pile to be driven into the sea floor by hydrostatic pressure.

11. The process of claim 10, further comprising the following steps:

(5) filling the upper portion of said pipe pile with a gas thereby displacing liquid from the interior of said pipe pile through said oneway valve means; and (6) evacuating said gas of step (5) from the upper portion of said pipe pile thereby causing said pipe pile to be driven into said sea floor by hydrostatic pressure.

12. The process of claim 11, further comprising the following step:

(7) repeating steps (5) and (6) until said pipe pile is buried.

13. The process of claim 10, wherein said pipe pile is provided with a diaphragm that slides axially upward within said pipe pile as said pipe pile is driven into said sea floor by hydrostatic pressure.

14. The process of claim 13, wherein said step (1) further comprises a first substep of filling said pipe pile with water, a second substep of filling the lower portion of said pipe pile with drilling mud by introducing said drilling mud tremie style on the upper surface of said diaphragm, and a third substep of filling a conduit with water, said conduit providing a passageway for liquids and gases between said pipe pile and the surface of said sea.

15. The process of claim 13, wherein step (4) further comprises forming an annular space between the interior surface of said pipe pile and the exterior surface of the soil core within the driven portion of said pipe pile.

16. The process of claim 14, wherein step (4) further comprises forming an annular space between the interior surface of said pipe pile and the exterior surface of the soil core within the driven portion of said pipe pile, and filling said annular space with drilling mud.

17. The process of claim 14, further comprising the following steps:

(5) filling the upper portion of said pipe pile with a gas thereby displacing liquid from the interior of said pipe pile through said one-way valve means; and (6) evacuating said gas of step (5) from the upper portion of said pipe pile thereby causing said pipe pile to be driven into said sea floor by hydrostatic pressure.

18. The process of claim 17, further comprising the following step:

(7) repeating steps (5) and (6) until said pipe pile is completely driven.

19. The process of claim 18, wherein steps (4) and (6) further comprise forming an annular space between the interior surface of said pipe pile and the exterior surface of the soil core within the driven portion of said pipe pile, and filling said annular space with drilling mud.

20. The process of claim 19, further comprising the steps of:

(5) closing said one-way valve means; and (6) forcing a pressurized liquid and/or gas into the interior of said pipe pile.

21. The process of claim 20, further comprising the step of:

(7) measuring the pressure of said liquid and/or gas of step (6) when said pipe pile begins to retract from the sea floor.

22. The process of claim 20, further comprising the step of:

(7) retracting said pipe pile from the sea floor.

23. The pile assembly of claim 1, wherein said pipe pile is curved.

24. The pile assembly of claim 1, wherein said pipe pile is long and straight.

25. A template comprising a three dimensional structure and three open end pipe piles, wherein one of said pipe piles is a pile assembly of claim 1, and each of said three pipe piles is attached to a different point on said structure.

26. A template comprising a three dimensional structure and three pile assemblies of claim 1, wherein each of said three pile assemblies is attached to a different point on said structure.

27. The pile assembly of claim 1, further comprising a means for producing a gas in the upper portion of the interior of said pile assembly.

28. The pile assembly of claim 7, further comprising means for producing a gas in the upper portion of the interior of said pile assembly.

29. The process of claim 10, wherein said pipe pile is curved.

30. The process of claim 10, wherein said pipe pile is long and straight.

31. A process of leveling a template comprising a three dimensional structure and three open end pipe piles attached to different points on said structure, wherein one of said pipe piles is driven by the process of claim 10.

32. A process of leveling a template comprising a three dimensional structure and three open end pipe piles attached to different points on said structure, wherein each of said three pipe piles is driven by the process of claim 10.

33. The process of claim 13, wherein said step (1) further comprises a first substep of filling said pipe pile with water, and a second substep of filling the lower portion of said pipe pile with drilling mud by introducing said drilling mud tremie style on the upper surface of said diaphragm, and wherein said step (3) comprises producing gas by a chemical reaction inside said pipe pile.

34. The process of claim 33, further comprising the following steps:

(5) filling the upper portion of said pipe pile with a gas thereby displacing liquid from the interior of said pipe pile through said one-way valve means; and (6) evacuating said gas of step (5) from the upper portion of said pipe pile thereby causing said pipe pile to be driven into said sea floor by hydrostatic pressure.

35. The process of claim 34, further comprising the following step:

(7) repeating steps (5) and (6) until said pipe pile is completely driven.

36. The process of claim 35, wherein steps (4) and (6) further comprise forming an annular space between the interior surface of said pipe pile and the exterior surface of the soil core within the driven portion of said pipe pile, and filling said annular space with drilling mud.

* * * * *